US010451027B2

(12) United States Patent
Bucher et al.

(10) Patent No.: US 10,451,027 B2
(45) Date of Patent: Oct. 22, 2019

(54) AXIAL PISTON MACHINE WITH OUTLET CONTROL

(71) Applicant: Mahle International GmbH, Stuttgart (DE)

(72) Inventors: Michael Bucher, Berlin (DE); Christoph Fiala, Potsdam (DE); Mirko Guenther, Berlin (DE); Michael Hoetger, Berlin (DE); Gunter Rzychon, Berlin (DE)

(73) Assignee: Mahle International GmbH (DE)

( * ) Notice: Subject to any disclaimer, the term of this patent is extended or adjusted under 35 U.S.C. 154(b) by 100 days.

(21) Appl. No.: 15/557,466

(22) PCT Filed: Mar. 9, 2016

(86) PCT No.: PCT/EP2016/055044
§ 371 (c)(1),
(2) Date: Sep. 11, 2017

(87) PCT Pub. No.: WO2016/146456
PCT Pub. Date: Sep. 22, 2016

(65) Prior Publication Data

US 2018/0058421 A1 Mar. 1, 2018

(30) Foreign Application Priority Data

Mar. 13, 2015 (DE) ..... 10 2015 103 743

(51) Int. Cl.
*F03C 1/06* (2006.01)
*F04B 1/14* (2006.01)
(Continued)

(52) U.S. Cl.
CPC ..... *F03C 1/061* (2013.01); *F01B 3/0002* (2013.01); *F01B 3/0017* (2013.01); *F01B 3/02* (2013.01);
(Continued)

(58) Field of Classification Search
CPC combination set(s) only.
See application file for complete search history.

(56) References Cited

U.S. PATENT DOCUMENTS 4,363,294 A 12/1982 Searle
5,267,839 A 12/1993 Kimura et al.

FOREIGN PATENT DOCUMENTS

DE 102004004692 A1 9/2005
DE 102010036917 A1 2/2012
(Continued)

OTHER PUBLICATIONS

English abstract for DE-102004004692.
(Continued)

*Primary Examiner* — Abiy Teka
(74) *Attorney, Agent, or Firm* — Fishman Stewart PLLC

(57) ABSTRACT

An axial piston machine may include a shaft and a housing surrounding at least a portion of the shaft. A cylinder arrangement may be disposed within the housing in a circular manner. The cylinder arrangement may include a plurality of cylinders and a plurality of pistons each extending within each of the plurality of cylinders and may be constructed and arranged to drive the shaft. The plurality of cylinders may each include an expansion volume with an inlet and at least one outlet opening for a working medium. A cylinder head may be provided on the housing and may be constructed and arranged to close the plurality of cylinders of the cylinder arrangement. A cavity may be defined around the shaft in a central region of the cylinder arrangement and may be in operative communication with a plurality of auxiliary outlet openings of the expansion volume of each of the plurality of cylinders via a temporary connection. A cylindrical roller slider may rotate within the cavity in the central region of the cylinder arrangement and may be constructed and arranged to drive the shaft. A temporary
(Continued)

connection between the cavity and the expansion volume of each of the plurality of cylinders may be formed by at least one of a channel through the cylindrical roller slider and a recess on an outside surface of the cylindrical roller slider. The recess may extend laterally from a casing of the cylindrical roller slider at a height of the plurality of auxiliary outlet openings in each of the plurality of cylinders and at a distance to the cavity in the central region of the cylinder arrangement.

20 Claims, 6 Drawing Sheets

(51) Int. Cl.

| | |
|---|---|
| ***F01B 3/00*** | (2006.01) |
| ***F03C 1/36*** | (2006.01) |
| ***F01B 3/02*** | (2006.01) |
| ***F01B 3/10*** | (2006.01) |
| ***F03C 1/40*** | (2006.01) |
| ***F04B 1/12*** | (2006.01) |
| ***F04B 1/28*** | (2006.01) |

(52) U.S. Cl.
CPC ..... *F01B 3/101* (2013.01); *F03C 1/0618* (2013.01); *F03C 1/0678* (2013.01); *F04B 1/122* (2013.01); *F04B 1/14* (2013.01); *F04B 1/28* (2013.01)

(56) References Cited

FOREIGN PATENT DOCUMENTS

| | | | | |
|---|---|---|---|---|
| DE | 102011052481 | A1 | 2/2012 | |
| DE | 102011118622 | A1 * | 5/2013 | ..... F01B 3/101 |
| EP | 1939448 | A1 | 7/2008 | |
| FR | 2426800 | A1 | 12/1979 | |
| GB | 364051 | A | 12/1931 | |
| WO | WO-2007117146 | A1 | 10/2007 | |

OTHER PUBLICATIONS

English abstract for DE-102011052481.
English abstract for DE-102011118622.
English abstract for DE-102010036917.

* cited by examiner

AXIAL PISTON MACHINE WITH OUTLET CONTROL

CROSS-REFERENCE TO RELATED APPLICATIONS

This application claims priority to International Patent Application No.: PCT/EP2016/055044 filed on Mar. 9, 2016 and German Patent Application No.: DE 10 2015 103 743.2 filed on Mar. 13, 2015, the contents of each of which are incorporated herein by reference.

TECHNICAL FIELD

The invention relates to an axial piston machine containing a shaft, a housing, a cylinder arrangement arranged in the housing in a circular manner comprising cylinders and pistons guided therein for driving the shaft, wherein the cylinders each have an expansion volume with an inlet and at least one outlet opening for a working medium, a cylinder head provided on the housing which closes the cylinders of the cylinder arrangement, and in the central region of the cylinder arrangement a cavity is provided around the shaft which can be connected to the expansion volume of the cylinder via a temporary connection.

BACKGROUND

Axial piston machines have a plurality of cylinders in each of which a piston performs a stroke. The stroke is transmitted to the shaft for example via a nutating disk or swashplate. In particular a generator or a vehicle can be driven with the rotating shaft. The inlet control for the working medium is accomplished by means of control units.

DE 10 2004 004 692 A1 teaches a valve-controlled axial piston machine. The arrangement comprises a rotating cam disk which is driven by the shaft. The cam disk controls valve tappets and by means of the valve tappets the valves on the respective inlet of the cylinder. The arrangement is bulky and complex.

Simpler axial piston machines with an inlet control are taught from the German patent applications DE 10 2011 052 481 and DE 10 2010 036 917.

SUMMARY

DE 10 2011 118 622 A1 discloses an axial piston machine of the type mentioned initially in which in the central region of the cylinder arrangement, a cavity is provided around the shaft which is delimited by a revolving rotary slide with an off-axis opening. The outlet openings pertaining to the cylinders are guided through the cylinder head. In this case, a temporary connection is made between the cavity and the expansion volume of the cylinder. With the known arrangement, the control times at the outlet can be implemented geometrically by the shape of the opening in the rotary slide. A disadvantage with this arrangement is that the outlet opening in the cylinder head is expensive to produce and that the additional channel in the cylinder head brings with it disadvantages in terms of efficiency.

It is the object of the invention to increase the efficiency of an axial piston machine of the type mentioned initially and reduce the manufacturing costs. According to the invention, the object is solved in an axial piston machine of the type mentioned initially whereby a cylindrical roller slider which is driven by the shaft rotates in the cavity in the central region of the cylinder arrangement, and the temporary connection between cavity and expansion volume is formed by at least one channel through the roller slider or a recess on the outside of the roller slider which extends laterally from the casing of the roller slider at the height of the auxiliary outlet openings in the cylinder as far as the cavity in the central region of the cylinder arrangement.

In typical axial piston machines, a plurality of cylinders are arranged in a circular manner around a shaft. The stroke direction runs parallel to the central axis of the shaft. The cylinders are delimited at the upper end by a common cylinder head.

Other that an auxiliary outlet channel which in known arrangements is guided through the cylinder head and a rotary slider, here a connection is made laterally from the casing of the roller slider to the cavity. The connection can be guided in the form of a channel or a bore through the body of the roller slider. Then the connection exists via the channel from a lateral opening located in the casing to an opening in the cavity-side end face of the roller slider. The connection can be implemented more cost-effectively in the form of an externally applied recess. This can be configured so that it extends from the casing as far as the cavity. A roller slider is a rotary component which can be produced cost-effectively, simply and very precisely. In addition to the production-dependent advantages however, the arrangements also acquires an increased efficiency. The volume in the outlet is smaller than when using an auxiliary outlet in the cylinder head with the result that the efficiency increases.

Advantageously a sealing sleeve guided through the cylinder head is provided which seals towards the roller slider. As a result, blow-by is avoided at the shaft over the roller slider and a better efficiency is achieved. Instead of the sealing sleeve, a sliding ring seal can also be used.

In a particularly preferred embodiment of the invention, the region between sealing sleeve and shaft as well as the region on the side of the sealing sleeve facing away from the roller slider are exposed to the pressure of the working medium. The vapour chamber of the arrangements produces vapour pressure which transfers the contact force. Additional springs or other components for pressing are not required.

In one embodiment of the invention, an anti-turn device for holding the sealing sleeve or a guide provided for the sealing sleeve is provided.

The roller slider can consist of steel, carbon, temperature-resistant plastic or an alloy containing copper, tin, zinc and/or nickel or a combination thereof.

Advantageously the material or the composition of the materials for the roller slider is selected in such a manner that it does not result in any abrasive wear on contact with the housing. In the event of inclination errors of the shaft, unintentional contact can occur. Then it is good if the slider only wears but does not lubricate or fret and block. Coated steel or high-temperature-resistant plastics such as are marketed under the tradenames Vespel, Torlon, Teflon or Piek are particularly well suited.

In a further embodiment of the invention, a gap between housing and roller slider is formed whose dimensions are selected in such a manner that the expansion caused by heat generation at operating temperature is taken into account. Plastic for example expands more severely than steel. Accordingly more space needs to be provided. Carbon on the other hand only expands to a small extent. The gap can be selected to be accordingly smaller. The arrangement must not have too much play during operation.

In a preferred embodiment of the invention, a spacer ring is provided between a shaft shoulder and the roller slider. The spacer ring can be made of a material having a thermal expansion which allows the roller slider to move into an optimal position when the machine is at operating temperature. Optimal means that the position is reached with respect to the sealing ring and the auxiliary outlet channel in which the auxiliary outlet channel is not completely or partially closed. A partial overlap produces an undesired flow edge and consequently a reduction in the efficiency.

The arrangement can have drain openings in the roller slider which open into the housing, wherein the housing is provided with an outlet opening to the condenser.

Embodiments of the invention are the subject matter of the subclaims. An exemplary embodiment is explained in detail hereinafter with reference to the appended drawings.

DETAILED DESCRIPTION OF THE DRAWINGS

Figure 1:
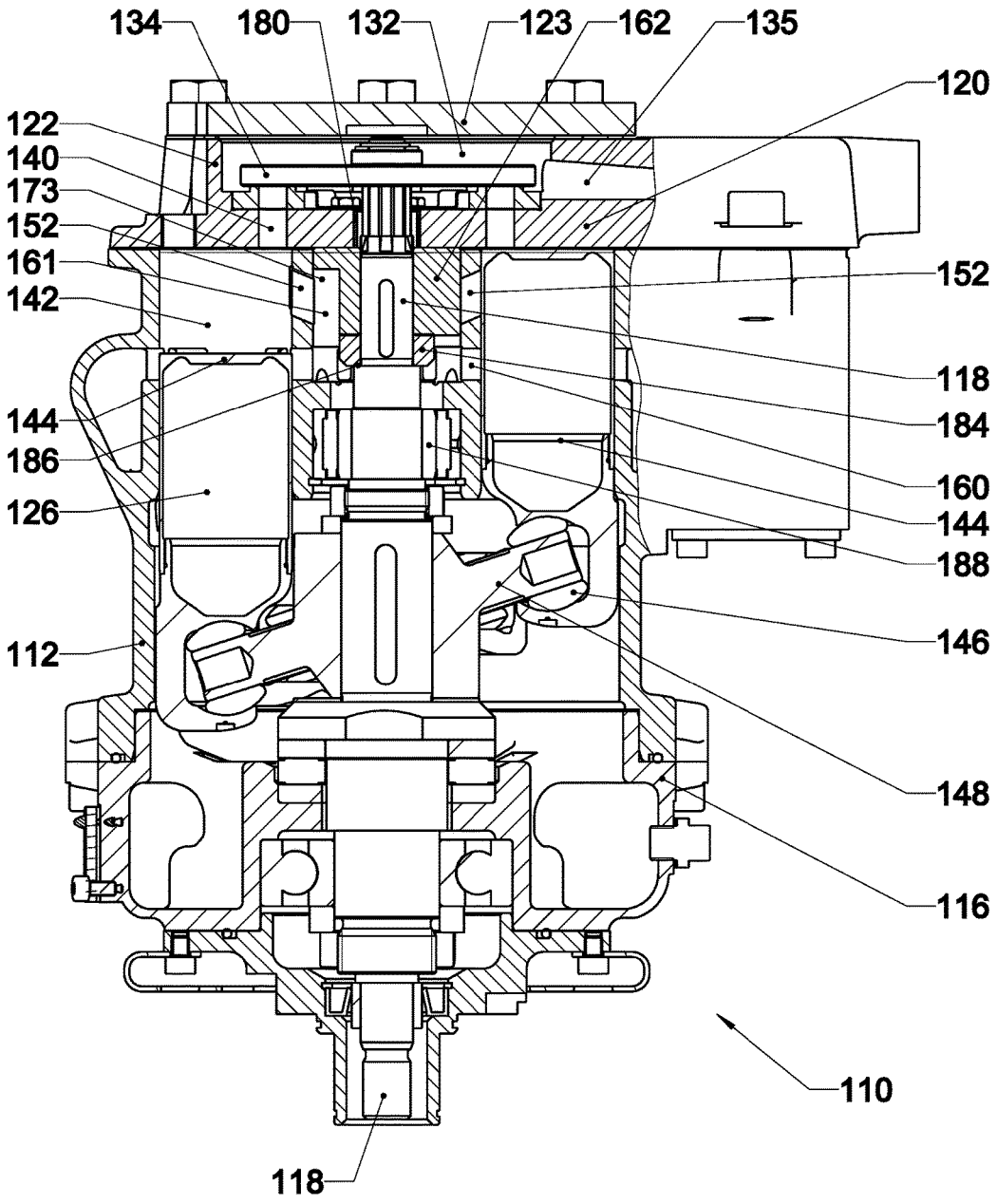
FIG. 1 shows a longitudinal section through an axial piston machine with roller slider.
Figure 2:
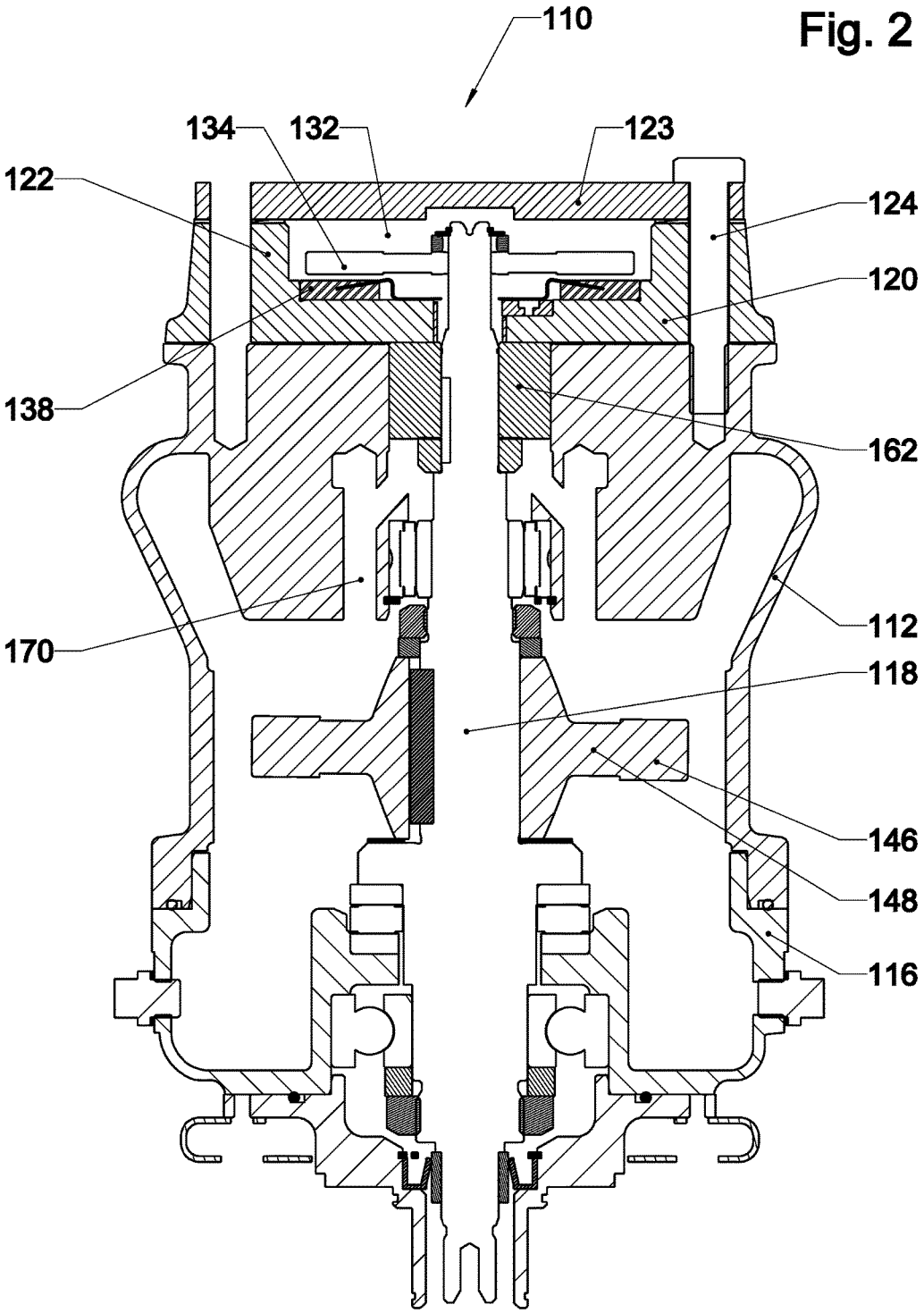
FIG. 2 shows a longitudinal section through the axial piston machine from FIG. 1 along another sectional plane.
Figure 3:
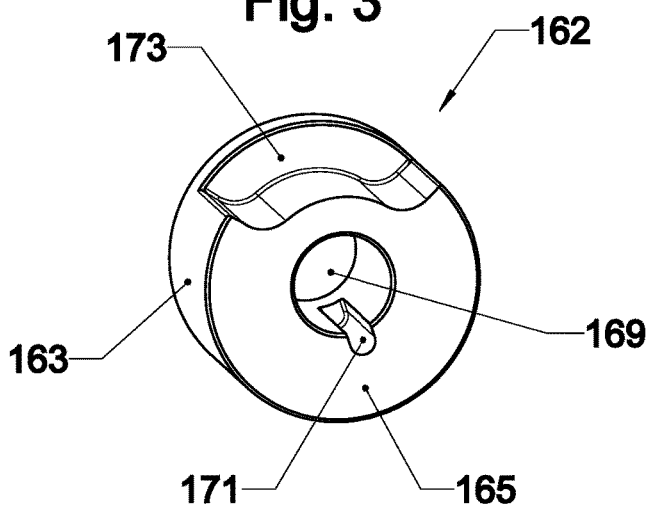
FIG. 3 shows a perspective view of the roller slider from the axial piston machine from FIG. 1.
Figure 4:
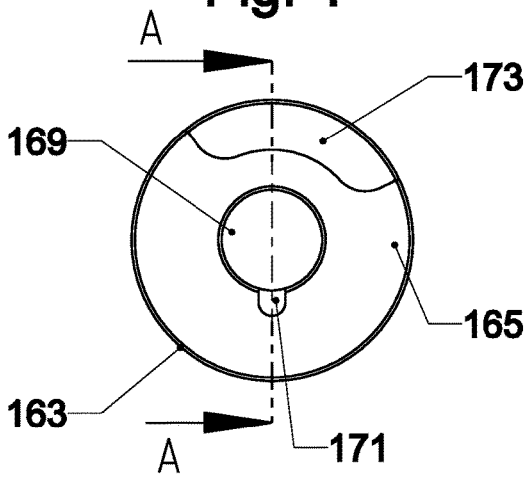
FIG. 4 shows a cross-section of the roller slider from FIG. 3.
Figure 5:
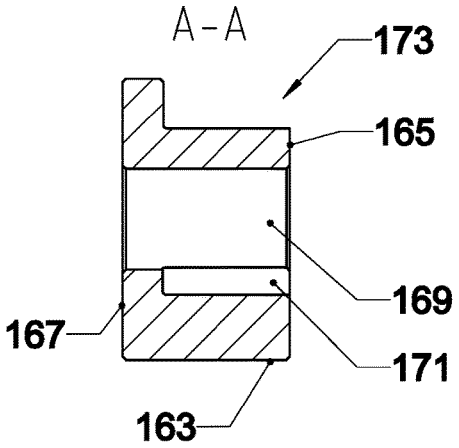
FIG. 5 shows a longitudinal section through the roller slider from FIG. 4 along the sectional plane A-A.
Figure 6:
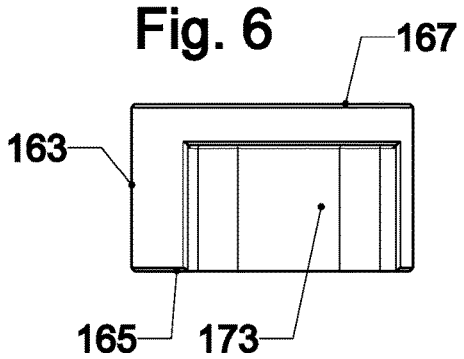
FIG. 6 shows a side view of the roller slider from FIG. 3.

FIGS. 1 and 2 show an axial piston machine generally designated by 110. The axial piston machine 110 has a two-part housing with cylindrical upper housing part 112 and a lower housing part 116. A rotatably mounted shaft 118 is guided coaxially through the housing 112 and 116. A disk-shaped cylinder head 120 is provided on the upper housing part 112. The cylinder head 120 and the housing part 112 are connected by bolts 124 which extend through the cylinder head 120. The ends of the bolts project upwards out of the housing as can be clearly seen in FIG. 2.

Five bores 142 are provided in the housing parts which are arranged in a circular manner around the shaft 118, parallel to the axis of rotation of the shaft. This is shown in FIG. 1. The bores 142 form the expansion volume of the cylinders of the axial piston machine 110. In exemplary embodiments not shown 7 or 9 bores are provided. Pistons 144 are guided in the bores 142. The pistons 144 have cavities 126. As a result these are light and only require little material.

Two sliding blocks 146 are rotatably mounted in the lower region of the pistons 144. The sliding blocks 146 have the shape of a spherical segment. A swashplate 148 is connected to the pistons 144 according to the number of pistons with several sliding blocks 146. The swash plate 148 is firmly connected to the lower part of the shaft 118.

A common disk-shaped cylinder head 120 is arranged at the upper end of the upper housing part 12. The upper part of the shaft 118 is guided through a central bore in the cylinder head 120. The upper end of the shaft 118 opens into an inlet chamber 132. The inlet chamber 132 is formed by a connecting projection 122 on the cylinder head with a cover 123. The connecting projection 122 has a bore 135 as inlet. In the inlet chamber 132 a disk-shaped rotary slider 134 revolves on a plastic bearing 138. The inlet chamber 132 can be connected via the inlet 135 to a source for pressurized working medium. For this purpose a vapour supply line is provided which opens into the inlet chamber 132.

The rotary slider 134 is connected positively to the upper part of the shaft 118 and is driven by this. The rotary slider 134 revolves at the upper end of the shaft 118. The plastic bearing 138 is disk-shaped and in the present exemplary embodiment consists of sintered plastic.

The rotary slider 134 has an off-centre passage. The cylinder head 120 has bores 140 in the region of the plastic bearing 138. Each cylinder of the axial piston machine is assigned a bore 140. The bores 140 are arranged in a circular manner around the shaft 118. The passage in the rotary slider 134 sweeps over the bores 140. The region around the bores 140 is curved in a somewhat protruding manner, whereby friction is reduced. The low friction brings about a high efficiency of the arrangement.

A cavity 161 is provided in the housing coaxially to the shaft 118. The cavity 161 is connected via a passage 170 (FIG. 2) to the surrounding space of the swashplate 148. The surrounding space of the swashplate is arranged in the region of the upper housing part 112. The housing part 112 is provided with an outlet via which a connection is made to the condenser. Accordingly condenser or atmospheric pressure prevails in the cavity 161 at each time point. The expansion volume of the cylinder formed by the bore 142 is further connected via main outlets 160 in the cylinder wall to the cavity 161.

In the cavity a roller slider 162 is arranged around the shaft 118. The roller slider 162 is shown separately in FIGS. 3 to 6. The roller slider 162 is substantially cylindrical with a casing surface 163 and two end faces 165 and 167. The roller slider 162 has a central bore 169. The shaft 118 extends through the central bore 169. Starting from the central bore 169 a recess 171 is provided in the radial direction. The recess 171 serves to receive an entrainer on the shaft. In this way the roller slider 162 is driven by the shaft 118.

A recess 173 is provided on the outside of the casing surface 163. In the present exemplary embodiment the recess 173 extends approximately over an angular range of 90°. Other exemplary embodiments with more or less cylinders have recesses 173 which cover a different angular range. The recess 173 extends in the axial direction from the end face 165 only over a partial region of the casing surface.

Respectively one auxiliary outlet 152 is provided at the upper end of the expansion volume in the bore 142 of the cylinder. Each cylinder has its own auxiliary outlet 152. This can be clearly seen in FIG. 1. The auxiliary outlet 152 extends directly from the bore 42 into the cavity 161.

The recess 173 in the roller slider 162 forms an off-axial passage at the axial height of the auxiliary outlets 152. The roller slider 162 also rotates with the shaft 118. In this way the recess successively sweeps over the auxiliary outlets 152.

The sealing sleeve 180 is arranged around the shaft 118 and seals the cylinder head 120 towards the roller slider 162. The sealing sleeve 180 is provided with a projection as an anti-turn device 182 which is received in a recess in the cylinder head. The sealing sleeve is therefore fixed to the housing and does not turn.

Figure 9:
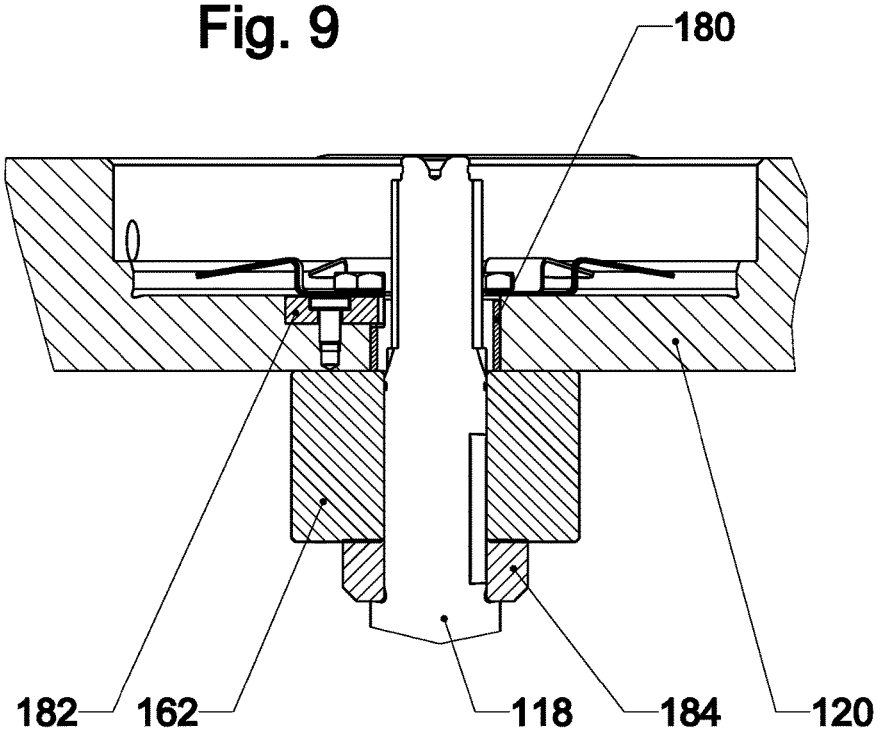
FIG. 9 shows a detail from FIG. 1 with the sealing sleeve.

Located below the roller slider 162 in FIG. 1, is a spacer disk 184 around the shaft 118. The spacer disk 184 sits on an annular shoulder 186 of the shaft and stabilizes the axial position of the roller slider 162. The shaft 118 is mounted in the bearing 188. This can be seen in FIG. 9.

The arrangement operates as follows:

Pressurized water vapour or another working medium passes through the vapour supply line and the inlet 135 into the inlet chamber 132. The passage in the rotary slider 134 during rotation of the shaft successively sweeps over the bores 140 with the rotary slider. The rotary slider 134 thus always only exposes one of the bores 140. This corresponds to the point 10 "inlet open" in FIG. 7 and FIG. 8.

Through the bore 140 water vapour enters into the cylinder with the expansion volume 142. There the water vapour expands. The relevant piston 144 moves downwards in the diagram in FIG. 1. This corresponds to the curve section 12 in FIGS. 7 and 8. The shaft 118 is driven in this way via the sliding blocks 146 and the swashplate 148. In this state the roller slider 162 closes the auxiliary outlet 152.

When the passage in the rotary slider 134 has passed the bore 140, the inlet closes. This point is designated by 16 in FIG. 7 and FIG. 8. Without further supply of working medium the piston moves further downwards and the expansion volume increases. This is associated with a pressure drop which is designated by 18 in FIG. 7 and FIG. 8.

When the piston has moved sufficiently far downwards, the outlet 160 opens making a connection between cavity 161 and cylinder interior 142. The working medium can escape outwards into the condenser via the outlet 160, the cavity 161, the passage and the outlet. This point is designated by 20 in FIG. 7 and FIG. 8.

Figure 7:
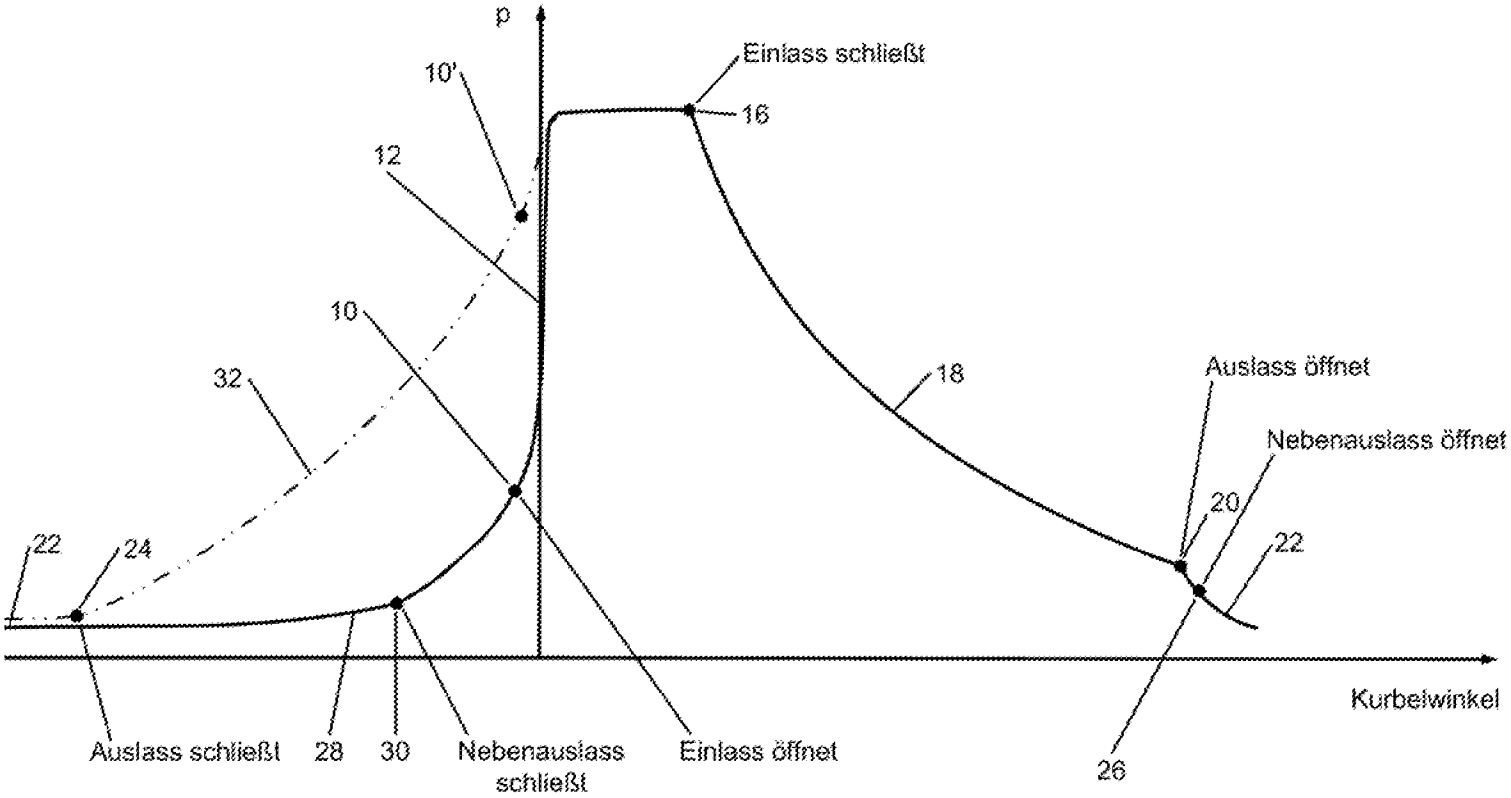
FIG. 7 is a diagram illustrating the pressure behaviour of the arrangement from FIG. 1 as a function of the crankshaft angle.
Figure 8:
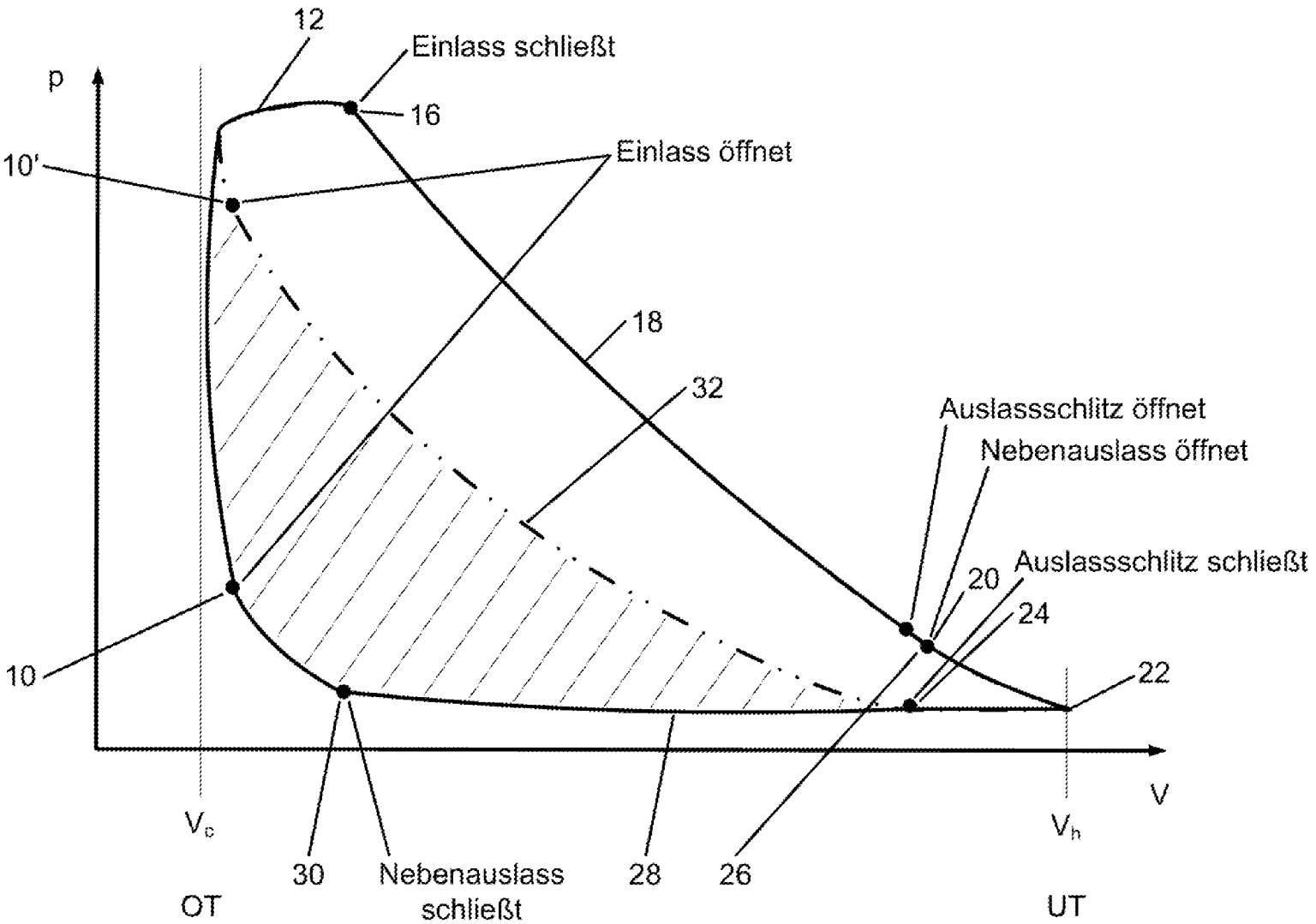
FIG. 8 shows a p-V diagram for the arrangement from FIG. 1.

After the lower dead point—designated by 22 in FIG. 7 and FIG. 8—the outlet 160 closes. This point is designated by 24 in FIG. 7 and FIG. 8. Shortly afterwards, during the upward movement of the piston 144, the recess 173 in the roller slider 162 sweeps over the auxiliary outlet 152. The auxiliary outlet opens. This point is designated by 26 in FIG. 7 and FIG. 8. With the outlet 160 closed, further working medium can then escape via the auxiliary outlet 152 into the cavity 161. The volume is reduced at constant pressure. The corresponding curve part is designated by 28 in FIG. 7 and FIG. 8. Accordingly less working medium is located in the expansion volume. Shortly before the inlet opens again, the auxiliary outlet is also closed. This point is designated by 30 in FIG. 7 and FIG. 8. The cycle is repeated.

FIG. 7 and FIG. 8 additionally show the situation for the case without an auxiliary outlet. The relevant curve is designated by 32. In the p-V diagram in FIG. 18 it can be seen that the area enclosed by the curve according to the work performed in the present exemplary embodiment is substantially greater than in arrangements according to the prior art when the area is delimited by the curve 32.

By using a roller slider, the opening and closing of the auxiliary outlet 152 is implemented by a single rotary part. The relevant volumes are small. As a result, a particularly good efficiency is achieved. The auxiliary outlet can be implemented by a simple, straight bore between cylinder 142 and cavity 161.

In the exemplary embodiments presented above, the terms "top" and "bottom" on the sectional views in the figures are not to be understood absolutely. The exemplary embodiments merely serve to further illustrate the invention and not to restrict the scope of protection which is defined by the appended claims. In particular, the invention can also be implemented on modifications. Thus, differently constructed housings and different numbers of cylinders can be used. The invention is also not restricted to a specific working medium. On the contrary, other working media are also suitable for expansion.

The invention claimed is:

1. An axial piston machine comprising:

a shaft rotatable about a rotation axis;

a housing surrounding at least a portion of the shaft;

a cylinder arrangement disposed within the housing in a circular manner, wherein the cylinder arrangement comprises a plurality of cylinders and a plurality of pistons each extending within each of the plurality of cylinders constructed and arranged to drive the shaft, wherein the plurality of cylinders each have an expansion volume with an inlet and at least one outlet opening for a working medium;

a cylinder head provided on the housing constructed and arranged to close the plurality of cylinders of the cylinder arrangement;

the housing having a cavity provided around the shaft in a central region of the cylinder arrangement, and the cylinder arrangement includes a plurality of auxiliary outlet openings respectively structured and arranged to connect the expansion volume of each of the plurality of cylinders to the cavity, wherein the cavity is in operative communication with the plurality of auxiliary outlet openings via a temporary connection;

a cylindrical roller slider disposed within the cavity, constructed and arranged to be driven by the shaft and rotate within the cavity in the central region of the cylinder arrangement; and wherein the temporary connection between the cavity and the expansion volume of each of the plurality of cylinders is provided by at least one of a channel through the cylindrical roller slider and a recess on an outside surface of the cylindrical roller slider, wherein the recess extends laterally from a casing of the cylindrical roller slider to the cavity in the central region of the cylinder arrangement and is arranged at a height of the plurality of auxiliary outlet openings in each of the plurality of cylinders; and wherein the plurality of auxiliary outlet openings are provided in a cylinder wall of the housing arranged radially between the expansion volume of each of the plurality of cylinders and the cavity.

2. The axial piston machine according to claim 1, further comprising a sealing sleeve disposed through the cylinder head, constructed and arranged to seal towards the cylindrical roller slider.

3. The axial piston machine according to claim 2, wherein a region between the sealing sleeve and the shaft and a region on a side of the sealing sleeve facing away from the cylindrical roller slider are exposed to a pressure of the working medium.

4. The axial piston machine according to claim 2, further comprising at least one of an anti-turn device constructed and arranged to hold the sealing sleeve and a guide constructed and arranged to guide the sealing sleeve.

5. The axial piston machine according to claim 2, wherein the sealing sleeve includes an anti-turn device constructed and arranged to hold the sealing sleeve.

6. The axial piston machine according to claim 5, wherein the anti-turn device comprises a projection which extends from the sealing sleeve, and wherein the projection is constructed and arranged to engage with a recess in the cylinder head.

7. The axial piston machine according to claim 1, wherein the cylindrical roller slider comprises at least one of a steel, a carbon, a temperature-resistant plastic, and an alloy containing at least one of a copper, a tin, a zinc, and a nickel.

8. The axial piston machine according to claim 1, wherein a material or a composition of materials for the cylindrical roller slider are constructed and arranged to prevent abrasive wear upon contact with the housing.

9. The axial piston machine according to claim 1, wherein the cylindrical roller slider is structured and arranged within the cavity such that a gap is defined between the housing and the cylindrical roller slider that is sized to account for an expansion caused by heat generation at an operating temperature.

10. The axial piston machine according to claim 1, further comprising a spacer ring disposed between a shaft shoulder and the cylindrical roller slider.

11. The axial piston machine according to claim 10, wherein the spacer ring comprises a material having a thermal expansion and is constructed and arranged to allow the cylindrical roller slider to move into an optimal position when the machine is at an operating temperature.

12. The axial piston machine according to claim 1, wherein the temporary connection between the cavity and the expansion volume of each of the plurality of cylinders is provided by the recess on the outside surface of the cylindrical roller slider.

13. An axial piston machine comprising:

a shaft;

a housing surrounding at least a portion of the shaft;

a cylinder arrangement disposed within the housing in a circular manner, wherein the cylinder arrangement comprises a plurality of cylinders and a plurality of pistons each extending within each of the plurality of cylinders constructed and arranged to drive the shaft, wherein the plurality of cylinders each have an expansion volume with an inlet and at least one outlet opening for a working medium;

a cylinder head provided on the housing constructed and arranged to close the plurality of cylinders of the cylinder arrangement, and wherein a cavity is defined around the shaft in a central region of the cylinder arrangement and is in operative communication with a plurality of auxiliary outlet openings of the expansion volume of each of the plurality of cylinders via a temporary connection;

a cylindrical roller slider disposed within the cavity, constructed and arranged to be driven by the shaft and rotate within the cavity in the central region of the cylinder arrangement;

a sealing sleeve disposed through the cylinder head, constructed and arranged to seal towards the cylindrical roller slider;

a spacer ring disposed between a shaft shoulder and the cylindrical roller slider; and wherein the temporary connection between the cavity and the expansion volume of each of the plurality of cylinders is provided by at least one of a channel through the cylindrical roller slider or a recess on an outside surface of the cylindrical roller slider.

14. The axial piston machine according to claim 13, wherein the temporary connection is provided by the recess on the outside surface of the cylindrical roller slider, wherein the recess is arranged at an axial height of the plurality of auxiliary outlet openings in each of the plurality of cylinders.

15. The axial piston machine according to claim 13, wherein the plurality of auxiliary outlet openings respectively extend directly from the expansion volume of each of the plurality of cylinders into the cavity.

16. The axial piston machine according to claim 1, wherein the plurality of auxiliary outlet openings respectively extend in a radial direction of the rotation axis directly from the expansion volume of each of the plurality of cylinders into the cavity.

17. The axial piston machine according to claim 1, wherein the cylindrical roller slider has a first end face that faces towards the cylinder head and a second end face that faces away from the cylinder head with the casing disposed therebetween in an axial direction of the rotation axis of the shaft, and wherein the recess provides the temporary connection and extends in the axial direction from the second end face partially along the casing towards the first end face.

18. The axial piston machine according to claim 17, wherein the plurality of auxiliary outlet openings are disposed on the cylinder wall between the first end face and the second end face of the cylindrical roller slider in the axial direction.

19. An axial piston machine comprising:

a shaft;

a housing surrounding at least a portion of the shaft;

a cylinder arrangement disposed within the housing in a circular manner, wherein the cylinder arrangement comprises a plurality of cylinders and a plurality of pistons each extending within each of the plurality of cylinders constructed and arranged to drive the shaft, wherein the plurality of cylinders each have an expansion volume with an inlet and at least one outlet opening for a working medium;

a cylinder head provided on the housing constructed and arranged to close the plurality of cylinders of the cylinder arrangement;

the housing having a cavity provided around the shaft in a central region of the cylinder arrangement, wherein the cavity is in operative communication with a plurality of auxiliary outlet openings of the expansion volume of each of the plurality of cylinders via a temporary connection;

a cylindrical roller slider disposed within the cavity, constructed and arranged to be driven by the shaft and rotate within the cavity in the central region of the cylinder arrangement;

a sealing sleeve disposed through the cylinder head, constructed and arranged to seal towards the cylindrical roller slider; and wherein the temporary connection between the cavity and the expansion volume of each of the plurality of cylinders is provided by at least one of a channel through the cylindrical roller slider and a recess on an outside surface of the cylindrical roller slider, wherein the recess extends laterally from a casing of the cylindrical roller slider to the cavity in the central region of the cylinder arrangement and is arranged at a height of the plurality of auxiliary outlet openings in each of the plurality of cylinders.

20. The axial piston machine according to claim 17, wherein a region between the sealing sleeve and the shaft and a region on a side of the sealing sleeve facing away from the cylindrical roller slider are exposed to a pressure of the working medium.

* * * * *